US007266920B2

(12) United States Patent
Kao

(10) Patent No.: US 7,266,920 B2
(45) Date of Patent: Sep. 11, 2007

(54) PICTURE FRAME HAVING AN INNER FRAME MOVABLY RECEIVED IN AN OUTER FRAME FOR EXHIBITING A PLANAR DRAWING OR A THREE DIMENSIONAL OBJECT

(76) Inventor: James Kao, 8F-1, No. 44, Sec. 1, Fusing S. Rd., Taipei (TW)

( * ) Notice: Subject to any disclaimer, the term of this patent is extended or adjusted under 35 U.S.C. 154(b) by 0 days.

(21) Appl. No.: 11/451,016

(22) Filed: Jun. 12, 2006

(65) Prior Publication Data

US 2007/0006504 A1 Jan. 11, 2007

(30) Foreign Application Priority Data

Jun. 14, 2005 (TW) ..... 94209933 U

(51) Int. Cl.
*A47G 1/06* (2006.01)

(52) U.S. Cl. ..... 40/800; 40/781; 40/765

(58) Field of Classification Search ..... 40/781, 40/577, 765, 491, 490, 488, 611.06, 611.07, 40/611.08, 611.09

See application file for complete search history.

(56) References Cited

U.S. PATENT DOCUMENTS

| | | | | |
|---|---|---|---|---|
| 1,119,544 | A * | 12/1914 | Schmidt | 312/311 |
| 3,790,772 | A * | 2/1974 | Newman et al. | 40/444 |
| 3,829,998 | A * | 8/1974 | Flax | 40/800 |
| 4,583,309 | A * | 4/1986 | Kane et al. | 40/711 |
| 4,831,754 | A * | 5/1989 | Tallent | 40/800 |
| 5,105,567 | A * | 4/1992 | Real | 40/765 |
| 6,553,704 | B1 * | 4/2003 | Pigg | 40/734 |

* cited by examiner

*Primary Examiner*—Cassandra Davis
(74) *Attorney, Agent, or Firm*—Alan Kamrath; Kamrath & Associates PA

(57) ABSTRACT

A picture frame includes an outer frame having an extension slit defined in at least one side face of the outer frame and an inner frame movably received inside the outer frame. The inner frame has a first slit defined through at least one side face of the inner frame to correspond to and align with the extension slit of the outer frame for receiving therein a hollow frame, a second slit defined through at least one side face of the inner frame for receiving therein a picture and a third slit defined through at least one side face of the inner frame for receiving therein a background board.

11 Claims, 10 Drawing Sheets

PICTURE FRAME HAVING AN INNER FRAME MOVABLY RECEIVED IN AN OUTER FRAME FOR EXHIBITING A PLANAR DRAWING OR A THREE DIMENSIONAL OBJECT

BACKGROUND OF THE INVENTION

1. Field of the Invention

The present invention relates to a picture frame, and more particularly to a picture frame having an inner frame movably received in an outer frame so as to receive therein a planar or a three dimensional object.

2. Description of the Prior Art

When in an exhibition, numerous drawings or pictures are framed by picture frames for two major reasons. One is that the picture frame is used to protect the artwork from damage of any kind and the other reason is that the picture frame is used to enhance the quality of the artwork in exhibition. No matter what reason the picture frame is used with the artwork, a cold and untouchable feeling is presented, which shows distance to the observers. More over, a piece of glass is mounted in front of the artwork so that the observer may not touch or feel the artwork being exhibited. Adding the piece of glass is somewhat like putting an armor on the artwork to further isolate the artwork from the observers.

Furthermore, the conventional picture frame has to be custom-made so as to adapt to different sizes of the artworks, which increases the cost in manufacture of different picture frames.

To overcome the shortcomings, the present invention tends to provide an improved picture frame to mitigate the aforementioned problems.

SUMMARY OF THE INVENTION

The primary objective of the present invention is to provide an improved picture frame having an inner frame movably received inside an outer frame so as to exhibit an artwork vividly.

Another objective of the picture frame of the present invention is that the outer frame has slits defined through at least one side face of the outer frame to allow extension of a planar drawing.

Still another objective of the present invention is that the inner frame is provided with different latitudinal and longitudinal grooves respectively defined in inner side faces of the inner frame so that a supporting plate is able to be positioned and supported by two corresponding latitudinal grooves and a three dimensional artwork is able to be seated on top of the supporting plate for exhibition.

A further objective of the picture frame is that a background board is extendable into one of the slits of the outer frame to enhance the beauty of the artwork in exhibition.

Other objects, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 4, it is noted that the picture frame (1) in accordance with the present invention includes an inner frame (2) having two opposed openings and an outer frame (3) having the inner frame (2) movably received therein and two opposed openings in communication with the two openings of the inner frame (2).

Figure 1:
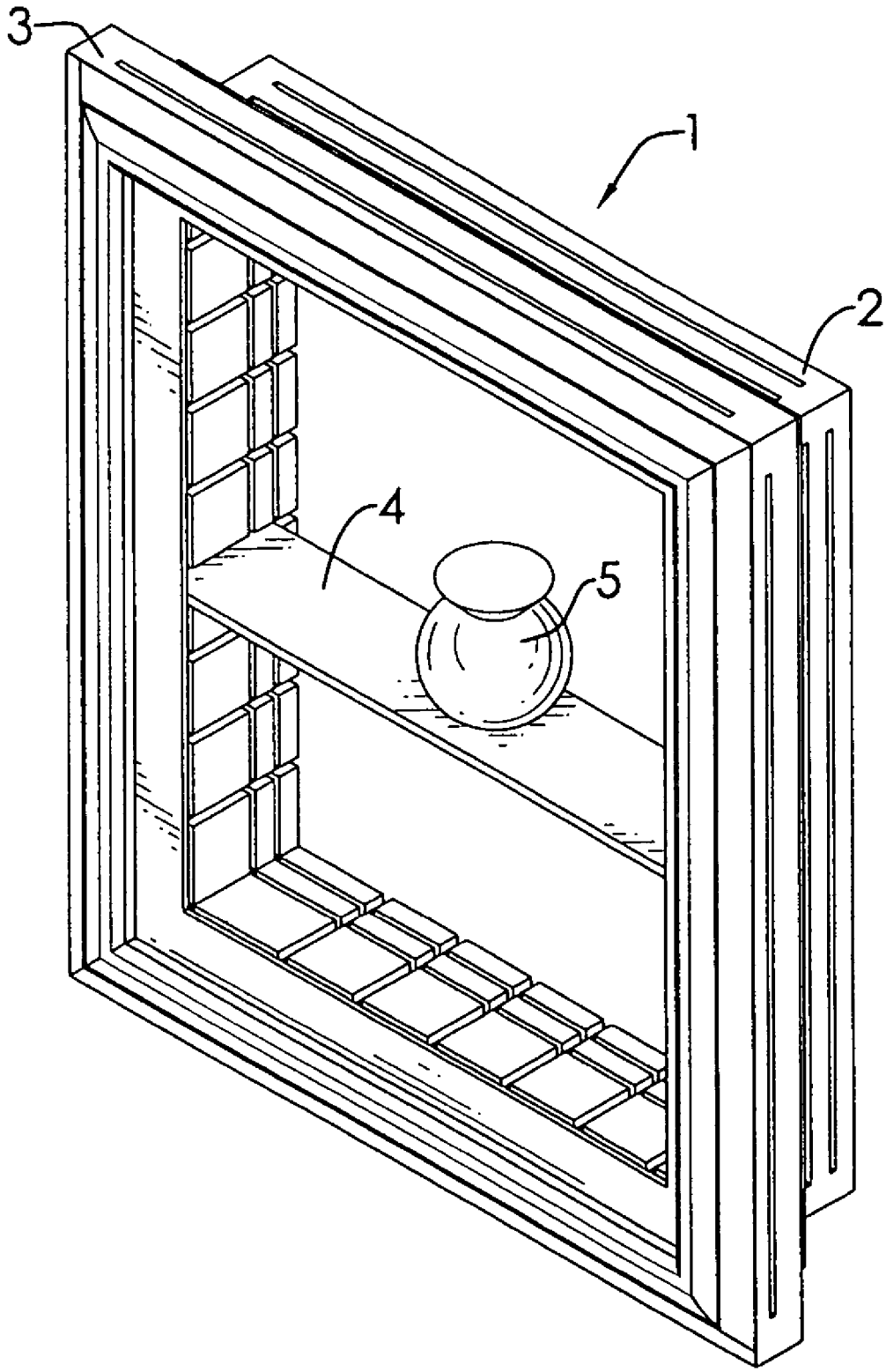
FIG. 1 is a perspective view of the picture frame of the present invention.
Figure 3:
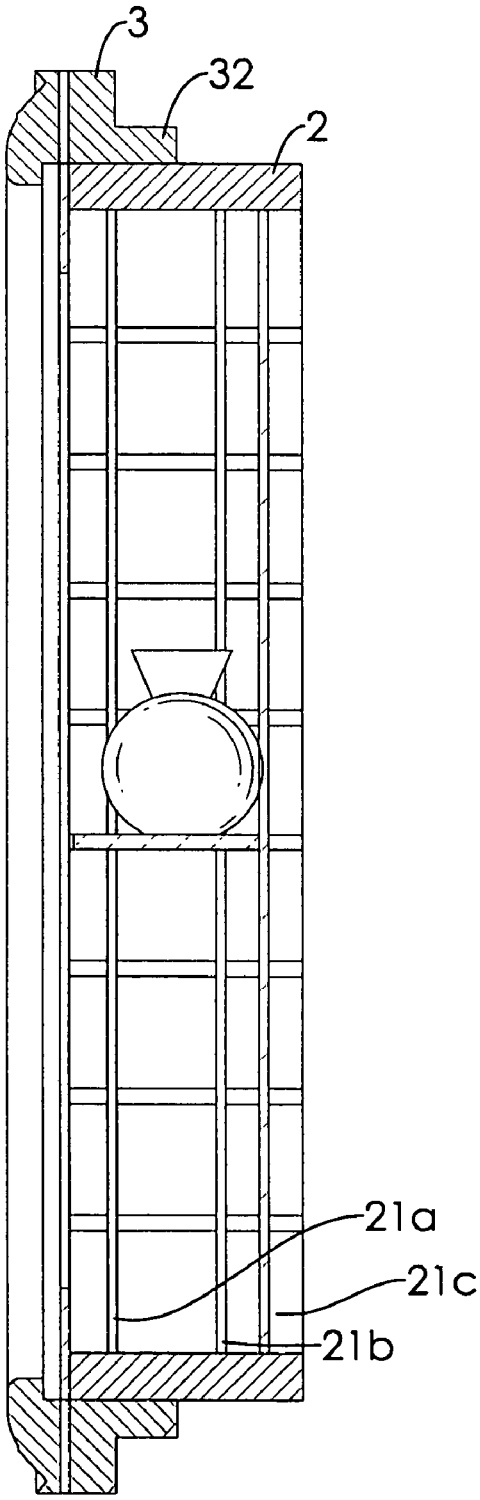
FIG. 3 is a cross sectional view of the picture frame as shown in FIG. 1.
Figure 2:
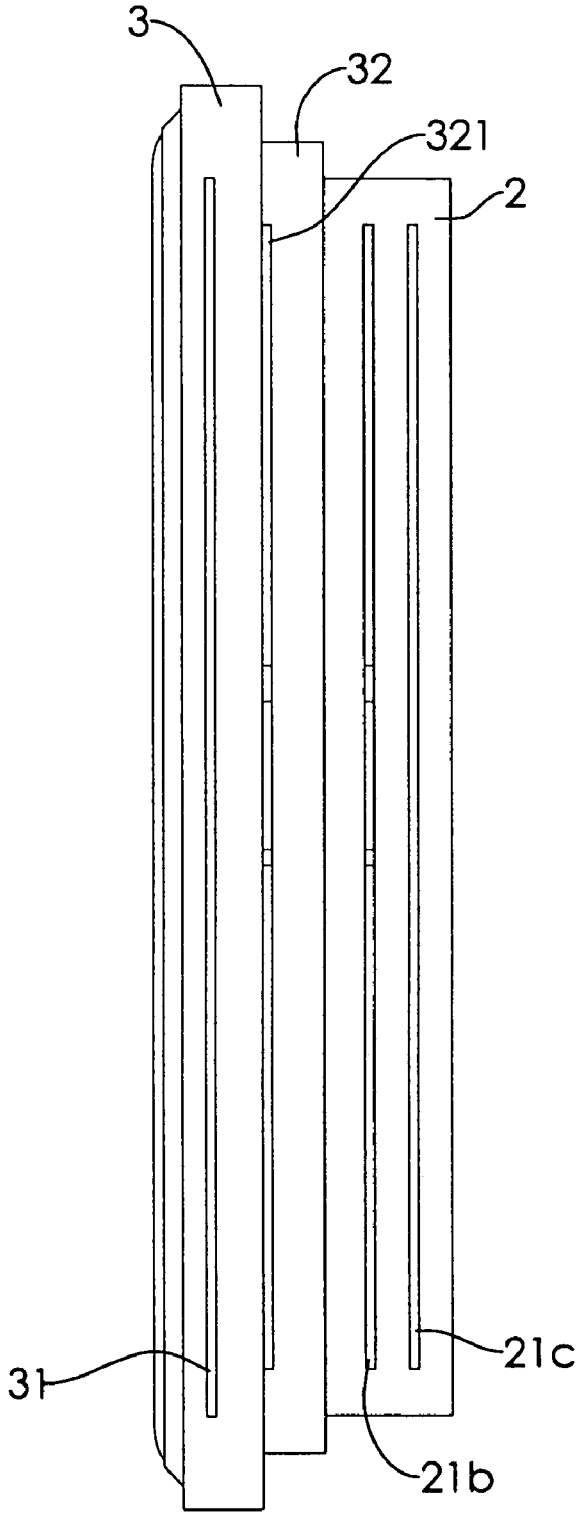
FIG. 2 is a side plan view of the picture frame as shown in FIG. 1.
Figure 4:
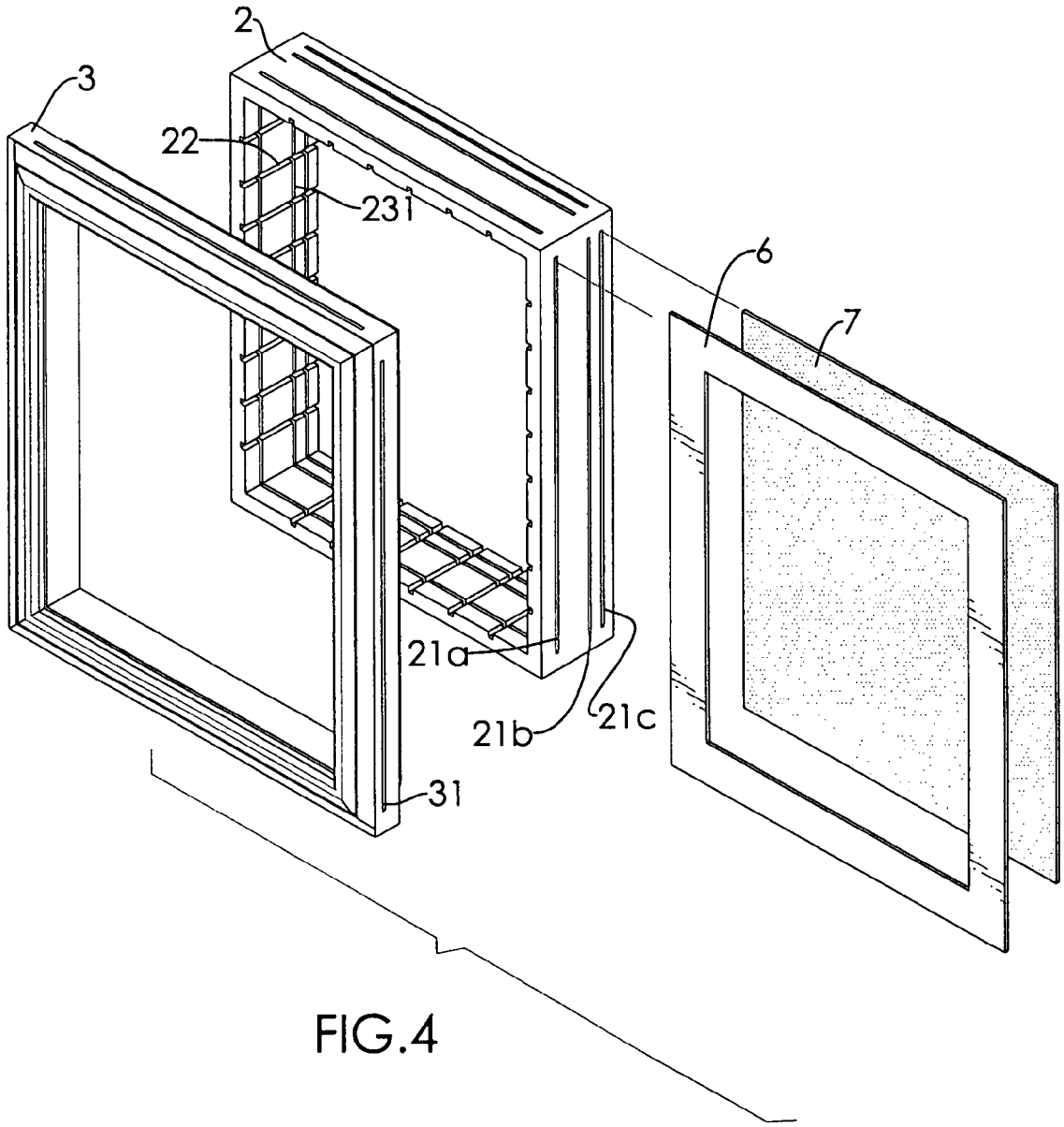
FIG. 4 is an exploded perspective view of the picture frame in a different embodiment.

The inner frame (2) is provided with slits (21), i.e., a first slit (21*a*), a second slit (21*b*) and a third slit (21*c*), defined in at least one side face thereof (two sides, a right side and a top side from the drawing of FIG. 4, are provided with slits (21)), latitudinal grooves (22) latitudinally defined in inner side faces of the inner frame (2) and longitudinal grooves (23) longitudinally defined in the inner side faces of the inner frame (2) to intersect with the latitudinal grooves (22).

The outer frame (3) has an extension slit (31) defined in at least one side face thereof (two sides, a right side and a top side from the drawing of FIG. 4 are provided with the extension slit (31)) and a step (32) formed on an outer contour of the outer frame (3) and having an aligning slit (321) defined in at least one side face of the step (32) to correspond to and align with the first slit (21*a*) of the inner frame (2).

Furthermore, a supporting board (4) is provided to the inner frame (2). The supporting board (4) is inserted into the inner frame (2) and supported by two corresponding latitudinal grooves (22) of the inner frame (2) so as to support an artwork (5) for display. A hollow frame (6) may be provided to the picture frame (1) of the present invention and is inserted into the extension slit (31) of the outer frame (3) and the first slit (21*a*) of the inner frame (2) to add in additional ornamental effect to the artwork (5) at display. Still further, a background board (7) may be inserted into the third slit (21*c*) to be the background of the artwork (5).

Figure 5:
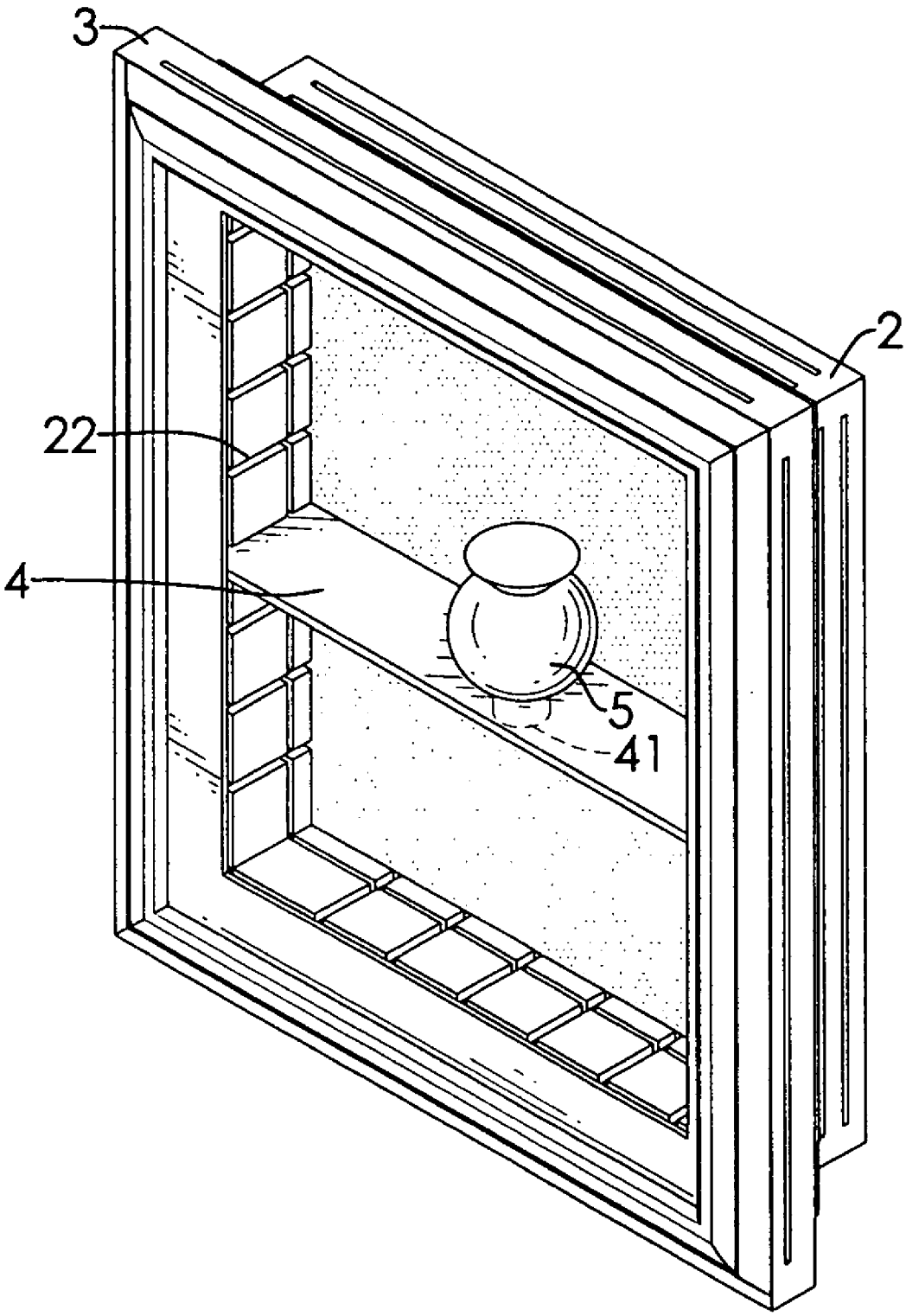
FIG. 5 is a perspective view showing that a supporting board is provided inside the picture frame and has a hole defined through the supporting board to securely position the artwork in exhibition.

With reference to FIG. 5, it is noted that because the inner frame (2) is smaller than that of the outer frame (3), after the inner frame (2) is inserted into the outer frame (3), the inner frame (2) is able to be movable relative to the outer frame (3). Therefore, when the artwork (5) for display is supported by the supporting board (4) which is supported by two corresponding latitudinal grooves (22) of the inner frame (2), moving the inner frame (2) relative to the outer frame (5) is able to increase/decrease 3D effect of the artwork (5) as required. Further, the supporting board (4) may be provided with a hole (41) so that if the artwork (5) is sharp at the bottom thereof, the artwork may still stand on the supporting board (4) for display.

When the artwork for display is a planar piece of work, the operator may insert the artwork from the second slit (21*b*) at the right side or the top side of the inner frame (2) to be positioned and supported by two corresponding and adjacent longitudinal grooves (23) respectively at two adjacent inner sides of the inner frame (2).

Figure 6:
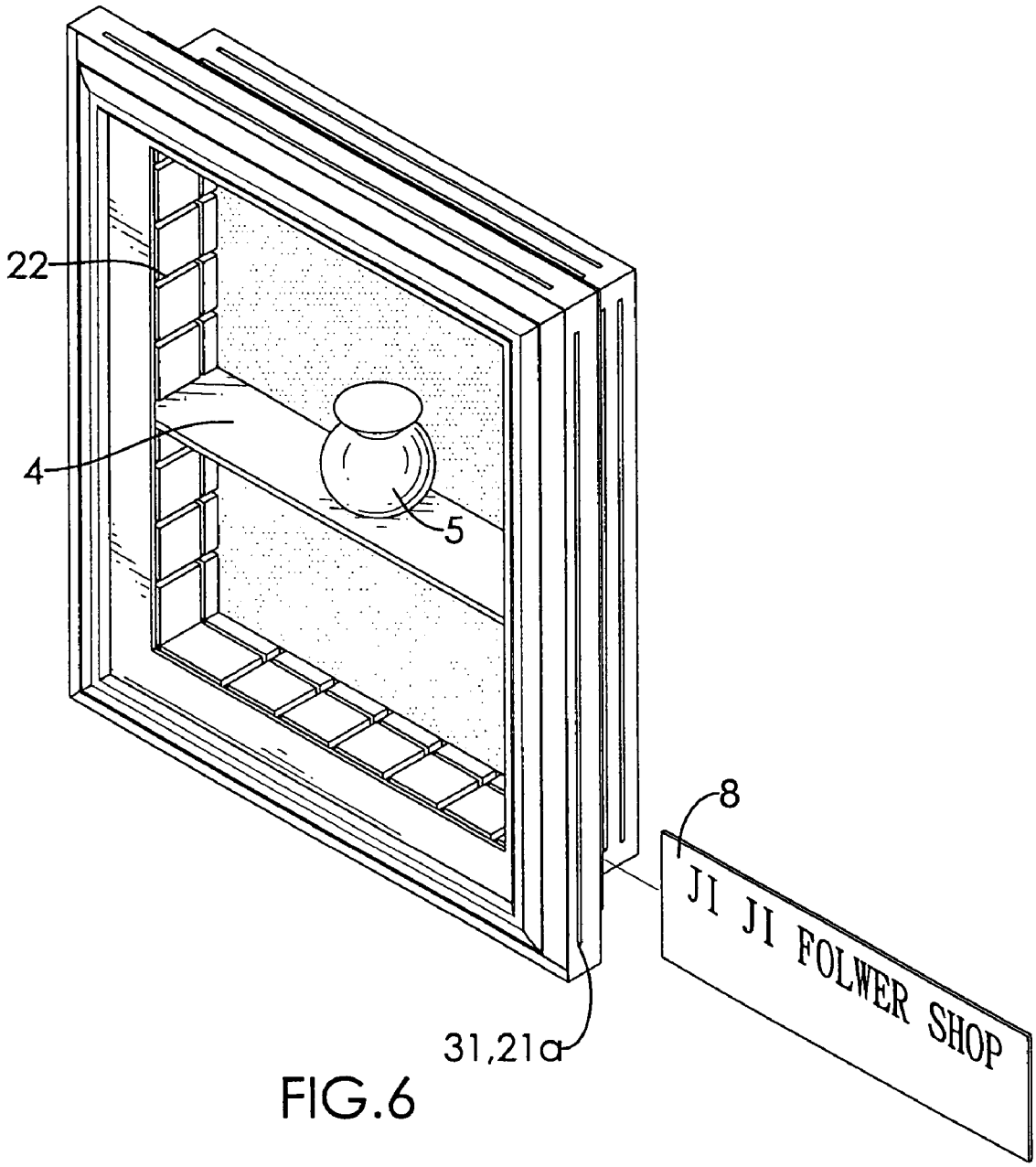
FIG. 6 is an operational view showing that a description plate is added to the picture frame of the present invention.
Figure 7:
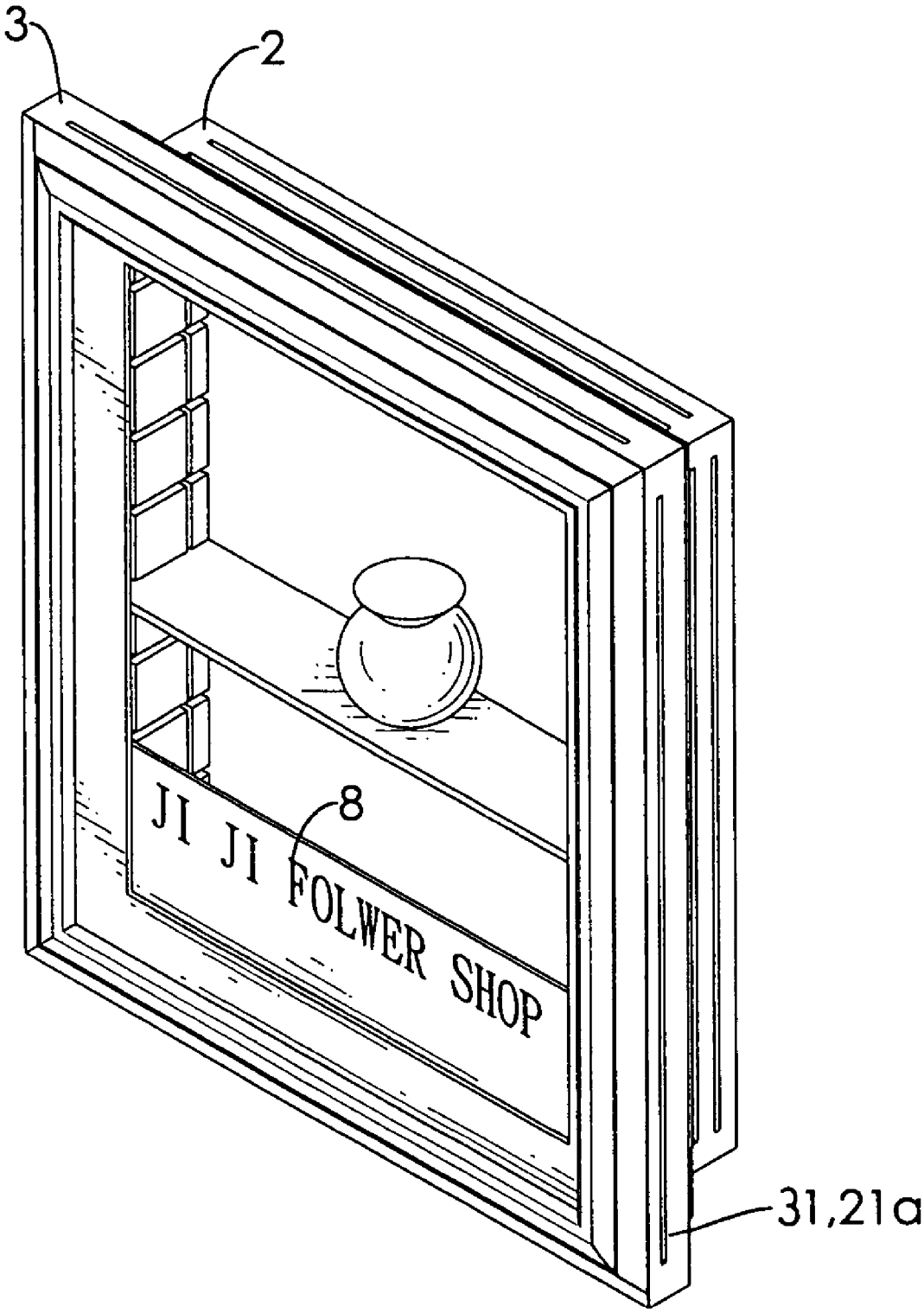
FIG. 7 is a schematic view showing that the description plate is inserted into the picture frame.

With reference to FIGS. 6 and 7, it is to be noted that a description plate (8) may also be inserted into the aligned extension slit (31) of the outer frame (3) and the first slit (21*a*) of the inner frame (2) to facilitate the observer to understand the background of the artwork (5).

Figure 8:
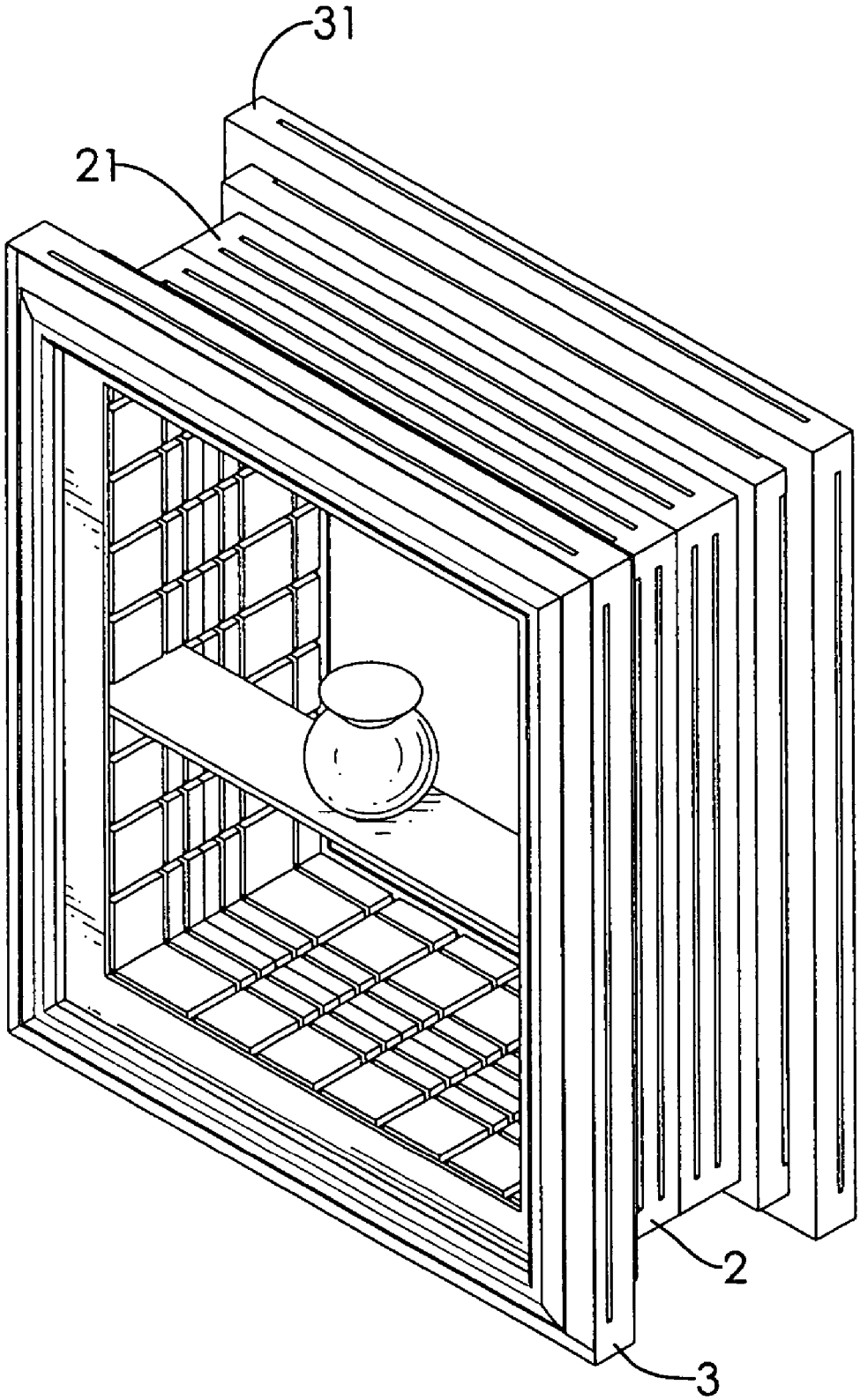
FIG. 8 is a perspective view showing a combination of two inner frames and two outer frames.
Figure 9:
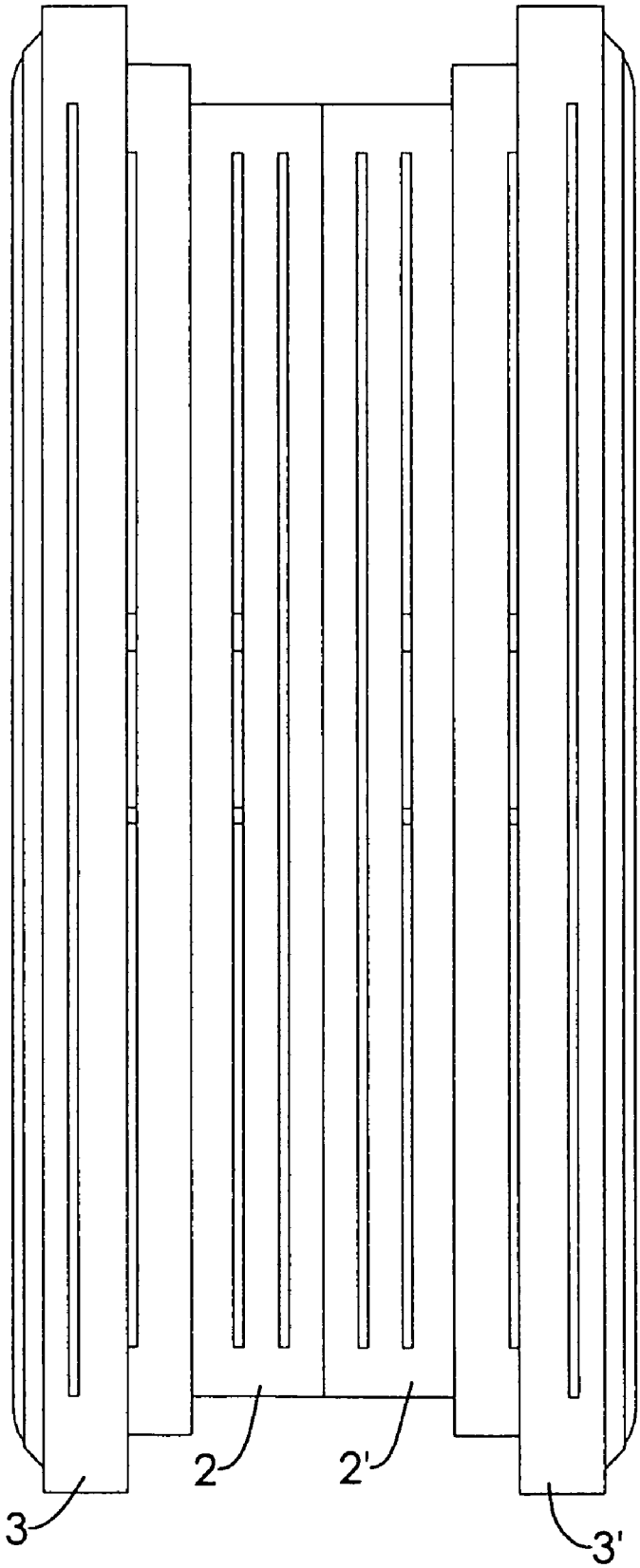
FIG. 9 is a side plan view showing the picture frame in the embodiment shown in FIG. 8.
Figure 10:
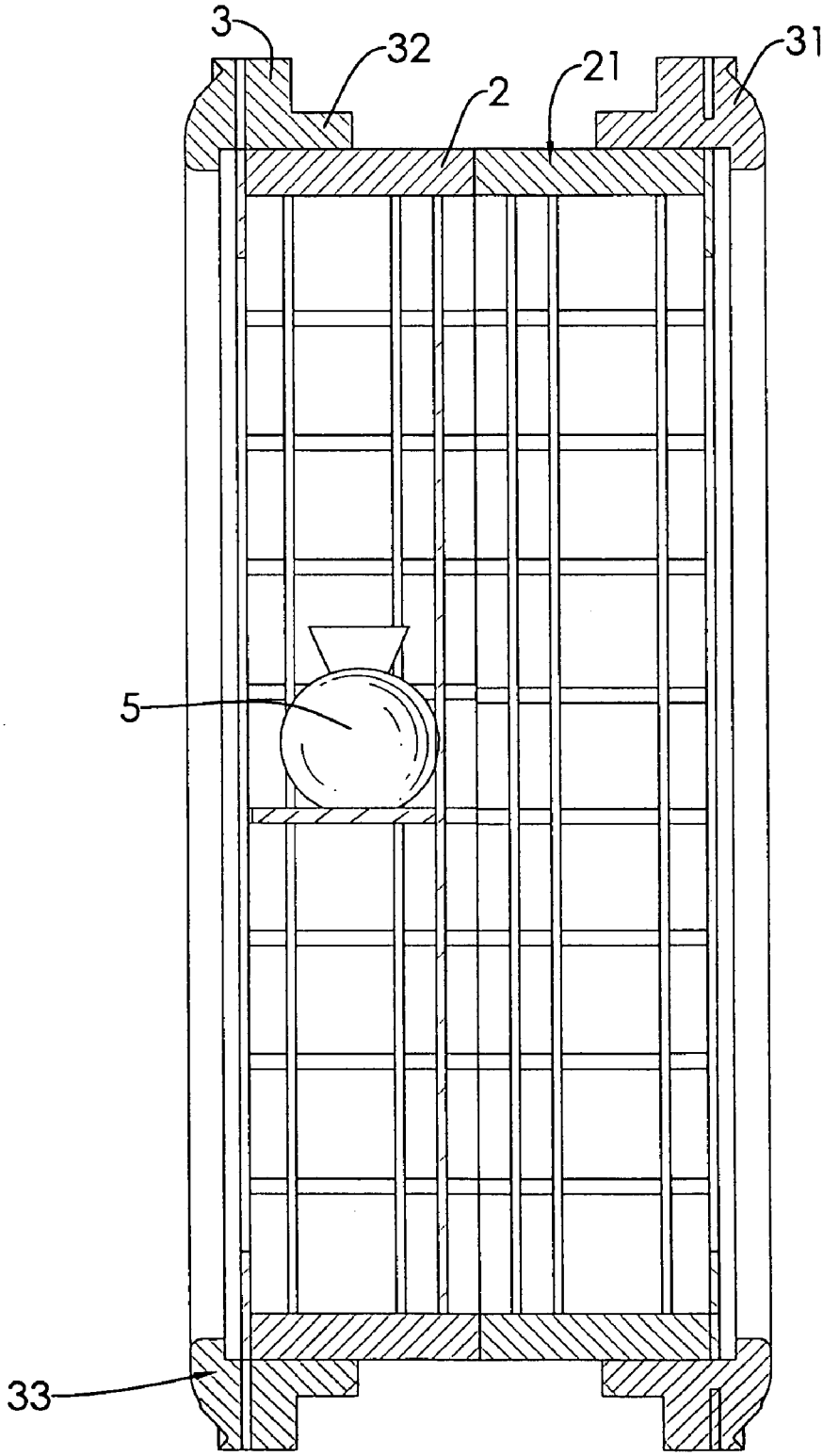
FIG. 10 is a cross sectional view of the embodiment shown in FIG. 9.

With reference to FIGS. 8, 9 and 10, it is noted that the picture frame of the present invention is now provided with an additional inner frame (2') securely connected to the inner frame (2) and an additional outer frame (3') movably receiving therein the inner frame (2'). Although the combination of two inner frames (2,2') may still be one single inner frame, the depth of the inner frame in this embodiment is now increased such that the operator is able to use the increased depth of the picture frame of the present invention in this embodiment to further enhance the quality of the artwork. The outer frames (3,3') may each have a protrusion leg (33) extending out from a respective bottom face of the outer frames (3,3') to enable the picture frame in this embodiment to stand by itself.

Figure 11:
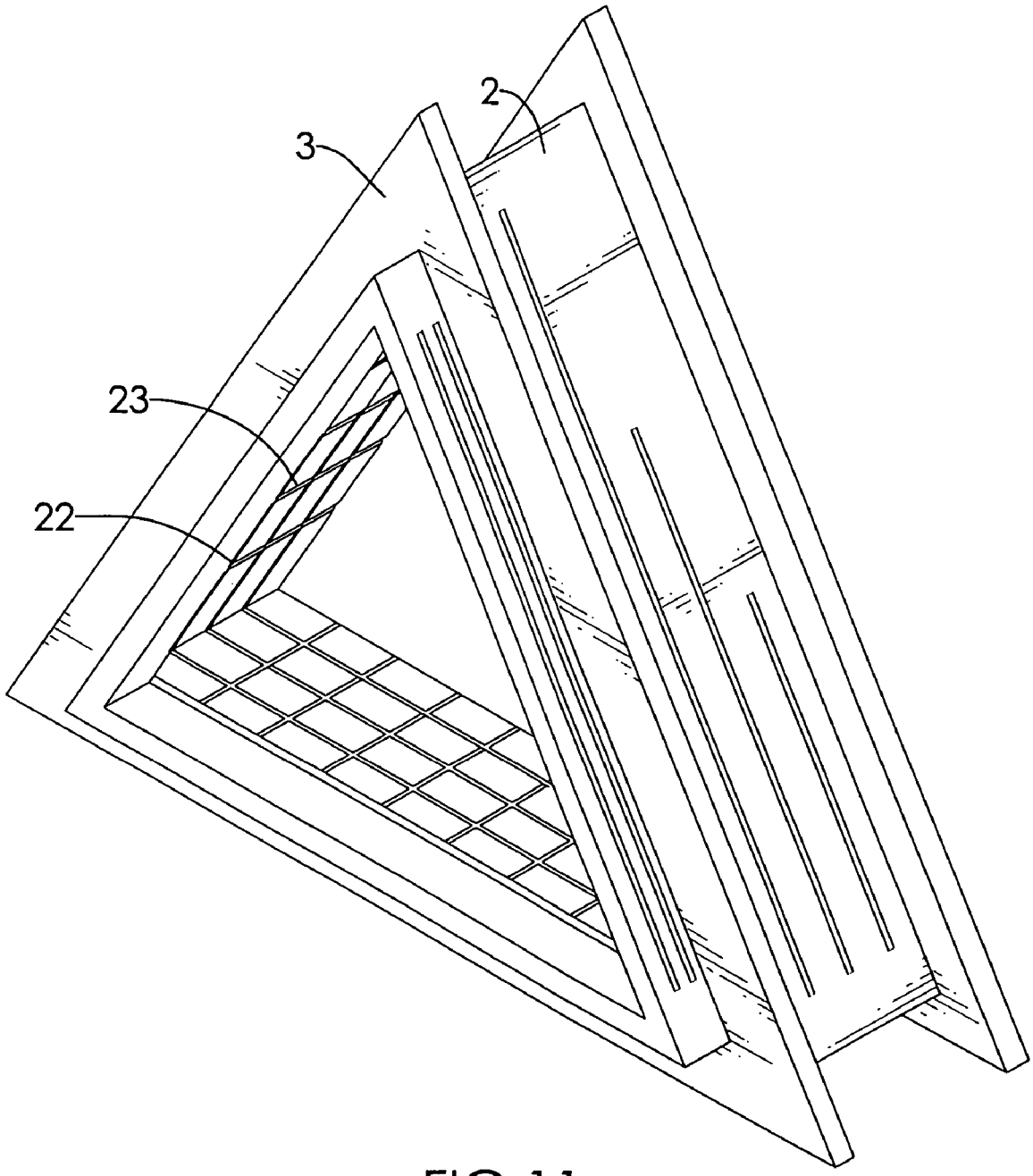
FIG. 11 is a perspective view of still a different embodiment of the picture frame of the present invention.

Although the embodiments shown in FIGS. 1-9 are rectangular in shape, different shapes may also be included in the spirit of the invention. For example, the triangular shape as shown in FIG. 11 is also applicable as long as the inner frame (2) having therein multiple latitudinal grooves (22) latitudinally defined in inner side faces of the inner frame (2) and longitudinal grooves (23) longitudinally defined in the inner side faces of the inner frame (2) to intersect with the latitudinal grooves (22) is movable inside the outer frame (3).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A picture flame comprising: an outer frame having an extension slit defined in at least one side face of the outer frame; and an inner flame movably received inside the outer frame and having a first slit defined through at least one side face of the inner flame to correspond to and align with the extension slit of the outer flame for receiving therein a hollow frame, a second slit defined through at least one side face of the inner frame for receiving therein a picture and a third slit defined through at least one side face of the inner flame for receiving therein a background board, the second and third slits are space behind the first slit.

2. The picture frame as claimed in claim 1, wherein the inner frame has multiple latitudinal grooves latitudinally defined in at least two inner side faces of the inner frame for supporting a supporting board between two corresponding latitudinal grooves.

3. The picture frame as claimed in claim 2, wherein the inner frame further has multiple longitudinal grooves longitudinally defined in the at least two inner side faces of the inner frame to intersect the latitudinal grooves for positioning the picture inserted from the second slit of the inner frame.

4. The picture frame as claimed in claim 2, wherein the outer frame has a protruding leg formed on an outer periphery of the outer frame so that the outer frame is able to stand on a surface.

5. The picture frame as claimed in claim 3, wherein the outer frame has a protruding leg formed on an outer periphery of the outer frame so that the outer frame is able to stand on a surface.

6. The picture frame as claimed in claim 1, wherein the outer frame has a protruding leg formed on an outer periphery of the outer frame so that the outer frame is able to stand on a surface.

7. A picture frame comprising:

an outer frame having an extension slit defined in at least one side face of the outer frame; and an inner frame movably received inside the outer frame and having a first slit defined through at least one side face of the inner frame to correspond to and align with the extension slit of the outer frame for receiving therein a hollow frame, a second slit defined through at least one side face of the inner frame for receiving therein a picture and a third slit defined through at least one side face of the inner frame for receiving therein a background board, wherein the inner frame has multiple latitudinal grooves latitudinally defined in at least two inner side faces of the inner frame for supporting a supporting board between two corresponding latitudinal grooves.

8. The picture frame as claimed in claim 7, wherein the inner frame further has multiple longitudinal grooves longitudinally defined in the at least two inner side faces of the inner frame to intersect the latitudinal grooves for positioning the picture inserted from the second slit of the inner frame.

9. The picture frame as claimed in claim 8, wherein the outer frame has a protruding leg formed on an outer periphery of the outer frame so that the outer frame is able to stand on a surface.

10. The picture frame as claimed in claim 7, wherein the outer frame has a protruding leg formed on an outer periphery of the outer frame so that the outer frame is able to stand on a surface.

11. A picture frame comprising:

an outer frame having an extension slit defined in at least one side face of the outer frame; and an inner frame movably received inside the outer frame and having a first slit defined through at least one side face of the inner frame to correspond to and align with the extension slit of the outer frame for receiving therein a hollow frame, a second slit defined through at least one side face of the inner frame for receiving therein a picture and a third slit defined through at least one side face of the inner frame for receiving therein a background board, wherein the inner frame has multiple latitudinal grooves latitudinally defined in at least two inner side faces of the inner frame for supporting a supporting board between two corresponding latitudinal grooves, wherein the inner frame further has multiple longitudinal grooves longitudinally defined in the at least two inner side faces of the inner frame to intersect the latitudinal grooves for positioning the picture inserted from the second slit of the inner frame; and wherein the outer frame has a protruding leg formed on an outer periphery of the outer frame so that the outer frame is able to stand on a surface.

* * * * *